United States Patent [19]

Rice

[11] 4,362,009

[45] Dec. 7, 1982

[54] YARN ACTUATED STOP MOTION DEVICE

[75] Inventor: Charles M. Rice, Candler, N.C.

[73] Assignee: Akzona Incorporated, Asheville, N.C.

[21] Appl. No.: 182,826

[22] Filed: Aug. 29, 1980

[51] Int. Cl.[3] ..... D01H 13/14; D01H 13/15

[52] U.S. Cl. ..... 57/86; 57/80; 57/84

[58] Field of Search ..... 57/80, 84, 85, 86, 87

[56] References Cited

U.S. PATENT DOCUMENTS

| | | | |
|---|---|---|---|
| 1,790,818 | 2/1931 | Jessen | 57/87 |
| 2,274,826 | 3/1942 | Elvin et al. | 57/87 |
| 3,034,278 | 5/1962 | Kay et al. | 57/86 |
| 3,452,531 | 7/1969 | Watson | 57/86 |

FOREIGN PATENT DOCUMENTS

| | | | |
|---|---|---|---|
| 1166402 | 6/1958 | France | 57/86 |
| 838134 | 6/1960 | United Kingdom | 57/86 |

*Primary Examiner*—Donald Watkins
*Attorney, Agent, or Firm*—Antonelli, Terry & Wands

[57] ABSTRACT

A yarn stop-motion device for use with a yarn-processing apparatus comprising yarn break-detector means, yarn cutting means and yarn guide means positioned close to each other and combined in a single unit. This device is characterized in that the yarn guide means releases the yarn into the yarn cutting means upon detection of a yarn break by said yarn break-detector means.

12 Claims, 7 Drawing Figures

YARN ACTUATED STOP MOTION DEVICE

This invention relates to a yarn stop-motion device having a yarn break-detector means, a yarn cutting means and yarn guide means arranged in close proximity to each other and combined in a single unit for use with yarn-processing apparatus such as drawing, winding, twisting and draw-twisting devices.

Heretofore, many devices have been developed for use with yarn processing machines that cut, trap, or otherwise sever yarn in response to a break in the yarn. For example, conventional wrap-control systems for draw-twisters consist of a break-detector near the pirn, a yarn cutter above the feed roll, and an electrical, pneumatic, mechanical or other interconnection between the detector and cutter.

These and other similar devices are described in the patent literature. For example, U.S. Pat. No. 3,452,531 describes an apparatus to be used in combination with a strand-winding machine for severing a yarn above a drafting system that is responsive to breaking of the yarn below the drafting system. In the apparatus disclosed, a trumpet is supported on a conventional traverse bar which reciprocally moves the trumpet laterally to the drafting system. Prior to passing through the trumpet, the yarn passes through a cutting device which is operatively associated with a counter-balanced pivotal means arranged to rest on the yarn below the drafting system. When the yarn breaks below the drafting system, the pivotal means moves downwardly to cooperate with the reciprocating trumpet to actuate the cutting means whereby the strand is severed. The pivotal means includes an arm which extends over the drafting means in contact with the yarn.

Numerous other devices are disclosed in the patent literature which also employ yarn break-detectors that are positioned away from means for causing severing or trapping of the yarn. Because the mechanical linkage or other connection between the yarn break-detector and the means for severing the yarn extends for a considerable distance through or over the yarn-processing machine, there is often difficulty in threading or stringing-up the machine, and equipment and installation costs are increased.

It is also known to provide yarn processing apparatus with yarn cutting devices for cutting a strand of yarn in response to a predetermined yarn pressure on the breakage of one of a plurality of yarn strands being processed. For example, U.S. Pat. No. 3,526,348 describes a yarn cutter assembly which includes a pair of guides that are mounted on a base and that define a guiding slot for the yarn strand with a stationary cutting blade extending across the slot for cutting the strand and a retaining member for holding the strand within the slot away from the blade and for releasing the strand to contact the blade in response to a pressure exerted by the strand on the retaining member. This device, therefore, requires an increase in yarn tension or pressure to effect the yarn cutting operation.

U.S. Pat. No. 3,120,093 illustrates a cutting device arranged between the yarn supply and the twister device that is used in a machine wherein a plurality of threads are twisted together and that in the event of breakage of one of the threads will cut the remaining threads and thereby prevent feeding of these threads for further twisting operations. This device employs a slidably supported guide member which slides to a new position of equilibrium upon the breakage of one of the threads and a pair of cutting blades arranged to cut the remaining threads when the guide member shifts to the new position. This device is dependent on the presence of a plurality of threads to establish an initial equilibrium of the guide member portion which must be positioned between the cutting blades and the yarn supply.

Heretofore, several of the disadvantages of the prior art have been overcome by the yarn-activated stop motion device disclosed in U.S. Pat. No. 3,938,311. This device has a yarn break-detector means and a yarn severing means combined into a single unit. In order to facilitate string-up of the device, a triggering two-arm lever is provided for holding the device in an inoperative position. This device has proved to be highly effective in operation, but its construction is somewhat complex.

Advantageously, the yarn-actuated stop-motion device of this invention positions the yarn break-detector means and a means for cutting the yarn closely adjacent to each other to provide a unit which can be mounted on or near a yarn-processing machine in a position that reduces costs and facilitates threading-up and maintenance of the machine.

Another advantage of the device of the present invention is that no external power source is required to effect actuation of the yarn-cutting means upon detection of a yarn break. Yet another advantage of the device is that the yarn cutting means is stationary and only one moving assembly is needed to support the yarn break detector means and yarn guide means for directing the yarn to the yarn cutting means upon breakage of the yarn.

The invention contemplates a yarn-actuated stop-motion device which comprises a yarn break-detector means, a yarn cutting means and yarn guide means for releasing the yarn into said cutting means upon detection of a yarn break by said yarn break-detector means. More particularly, this invention is directed to such a device having a supporting frame, a stationary yarn cutting means secured to said frame, yarn break-detector means pivotally mounted on said frame, and yarn guide means for guiding the yarn along a path outside of the cutting means during thread-up and normal operation and for releasing the yarn into the cutting means in the event of a yarn break. With this stop-motion device, the point at which the yarn break is detected by the device and the point at which the yarn is cut by the device are both positioned above or on the same side of the yarn-processing apparatus operatively associated with the device.

In one embodiment, the means for cutting the yarn comprises a cutter blade secured to the supporting frame and spaced from a guide surface by a predetermined narrowing gap so that when a running yarn is released into the gap, the yarn is forced between the blade and the guide surface and cut by the blade. Preferably, the gap is V-shaped with the open end of the gap facing a yarn guide element that releases the yarn into the gap.

The yarn guide means of the yarn stop-motion device includes a movable first guide element mounted at one end of the frame and a stationary second guide element mounted at the other end of the frame and spaced from the first guide element with the two guide elements being arranged so that the yarn is guided therebetween during normal operation in a substantially linear path adjacent to the yarn cutting means.

The pivotal support member comprises a substantially L-shaped lever having one arm on which a yarn break-detector element is mounted and another arm which is pivotally mounted via a pivot shaft and a support bracket of the frame. A counter-weight for effecting movement of the L-shaped lever is secured to the end of the other arm and causes the support member to rotate or pivot in a counter-clockwise direction.

The first yarn guide element is rotatable and is provided with two grooves or notches, with the first notch being operative to guide the yarn during string-up of the devices and the second notch being operative to guide and to retain the yarn out of the cutting means during normal operation of the device and the associated yarn processing apparatus. This guide element is located on the pivotal support member.

The second guide element is fixed directly to the support frame and is positioned below the first guide element and below the support bracket on which the pivotal support member is mounted.

In operation of the yarn stop-motion device of the invention, a yarn is passed through one notch of the first guide element to the second fixed guide element and is then led to a yarn-processing machine such as a draw-twister device. Subsequently, the yarn, rather than proceeding directly to a takeup, is instead returned from the yarn-processing machine, looped over the yarn break-detector element at one end of the pivotal support member, and then directed downwardly to a yarn take-up or pickup means, e.g., a pirn building device. The tension of the yarn applied to the yarn break-detector element on the one arm causes the pivotal support member to pivot clockwise in opposition to the force of the counter-weight at the end of the other arm, and, at the same time, the rotatable guide element rotates clockwise and the yarn in one notch advances a second notch. (It will be understood that the pivotal support member may be manually rotated clockwise by an operator prior to stringing or looping the yarn from the yarn-processing machine over the yarn-detector element.)

The tension or force applied by the loop of yarn to the break-detector element during normal operation of the yarn-processing machine maintains the yarn out of the yarn cutting means by maintaining the first guide element in a position wherein the second notch retains the yarn in a path away from or outside of the cutting means.

When the yarn breaks, the break-detector element moves upward and the first guide element is rotated counterclockwise, this rotation allows the second notch to release the incoming yarn into the cutting means so that the yarn is cut, the yarn being pulled across the cutting blade by a feed roll or other yarn transport device in the yarn-processing machine.

The device of this invention will be further understood from the following detailed description and with reference to the accompanying drawings wherein.

Figure 1:
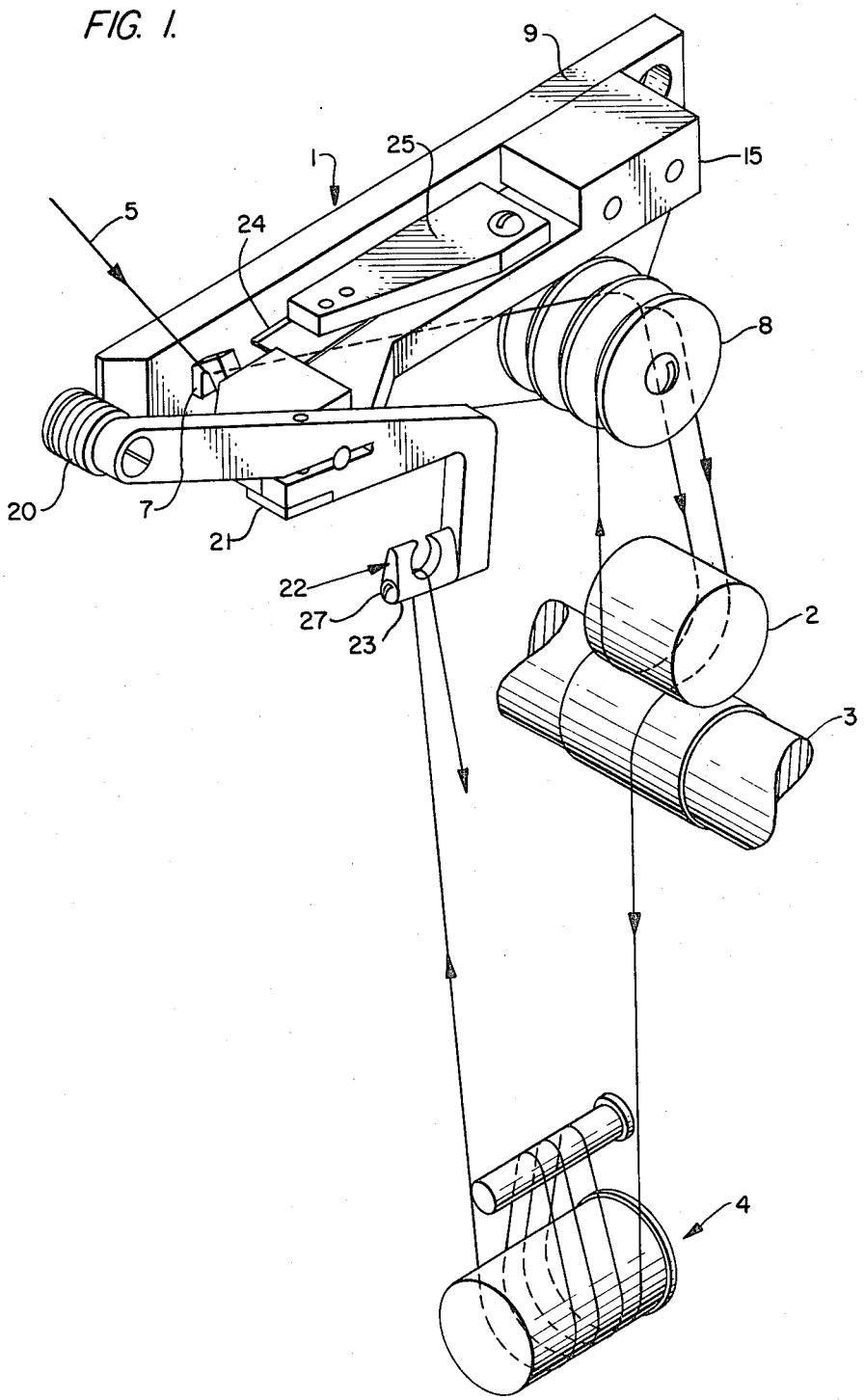
FIG. 1 is a perspective view showing the running position of the yarn stop-motion device of the invention used in connection with a yarn-processing machine, i.e., a draw-twister.

In FIG. 1, reference numeral 1 designates the yarn stop-motion device of the invention positioned above a pair of rolls including a presser roll 2 and a feed roll 3, and a draw-twister device 4 that includes a pirn building means (not shown). A yarn thread 5 is passed from a creel position initially through the yarn guide means of the stop-motion device to the feed roll 3 and then fed to the draw-twister device 4 wherein the yarn is fed backwardly up and over the yarn break-detector means of the stop-motion device. The yarn is then directed downwardly to the pirn building means of the draw-twister device.

Figure 2:
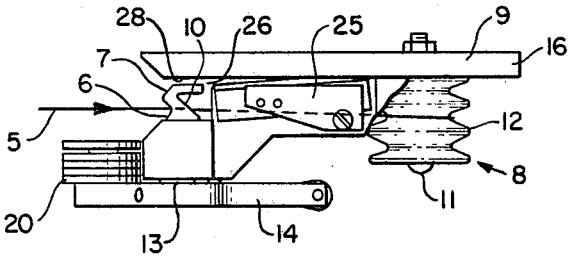
FIG. 2 is a top view of the stop-motion device with the device retained in the thread-up position.
Figure 3:
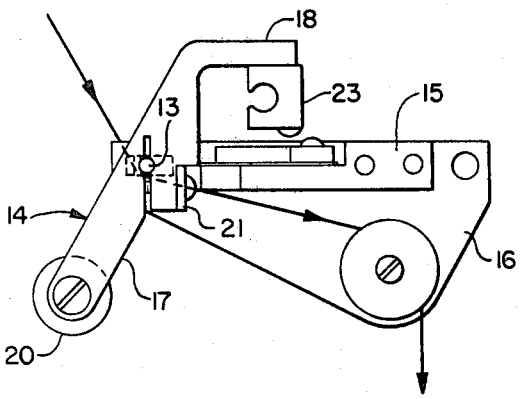
FIG. 3 is a front elevational view of the stop-motion device in the thread-up position shown in FIG. 2.

In order to thread-up the stop-motion device, the device should be in its thread-up position. This position is illustrated in FIGS. 2 and 3. In these Figures, the yarn 5 is initially passed through the outward facing groove or notch 6 of the rotatable guide element 7 and over a stationary guide element 8 which is secured to the supporting frame 9. The yarn is then passed downwardly towards the yarn processing apparatus which includes the pressure and feed rolls 2, 3.

The rotatable guide element 7 (which as shown in FIG. 2 has an S-like shape) also is provided with another groove or notch 10 which faces inwardly when the guide element is in a horizontal plane (as shown in FIG. 3). This other notch serves to guide and to retain the yarn during the running or operative position of the device.

The guide means 8 comprises a support 11 and a spool-type ceramic guide element 12. This element has a plurality of circular or annular guide channels for the yarn. Suitable ceramic material for the guide element includes aluminum oxide, for example.

The yarn guide element 7 is rotatable with the pivot shaft 13 of the pivotal support member 14 for the yarn break-detector means. In the embodiment shown, the element 7 is an extension of the shaft 13. Element 7 is formed of a suitable material for withstanding abrasion, and has rounded edges for contacting the yarn traveling to the yarn-processing apparatus.

Frame 9 is made of a suitable rigid material, for example, a synthetic polymer resin, cast metal, machined metal or the like. Preferably the frame 9 is machined from a light-weight metal and has, as shown in FIG. 1, an angular body consisting of a horizontal support bracket 15 and a vertical support member 16. The support bracket 15 is secured at one end to the vertical support member by screws or the like and is spaced from the other end of the vertical member.

The pivotal support member 14 has an L-like shape and includes a first arm 17 which is pivotally mounted onto the support frame 9 via shaft 13 and bracket 15 and a second arm 18 which extends approximately 45° to the first arm. This second arm is arranged to extend horizontally when the support member 14 is rotated clockwise by counter-weight 20 to the position shown in FIG. 3. A projection 21 extends laterally away from the first arm near the pivot point. This projection acts as a stop member for preventing further rotation of the pivotal support member 14. In the thread-up, the projection 21 extends laterally away from the first arm to the right of the pivot point position of the device as shown in FIGS. 2 and 3 and contacts the bottom surface of bracket 15 to prevent counter-clockwise rotation; whereas, in the running position as shown in FIG. 1, the projection extends to the left of the pivot point and contacts the bottom end surface of bracket 15 to prevent further clockwise rotation of the pivotal support member 14. In the running position of the device, it will be also seen from FIG. 1 that the guide element 7 is rotated through 90° and is now in a vertical position.

A yarn break-detector element 22 is secured to the free end of the second arm 18. This element comprises a ceramic guide element 23 and is mounted via a screw 27 to the arm 18. The guide element 23 has a notched or cut-out portion that provides a guide channel for the yarn.

At the other end of the pivotal support member, there is provided a counter-balance weight 20 in the form of a plurality of metal washers, the number of which may be changed to regulate the force on the yarn 5 at guide element 23. This weight serves to bias the pivotal support member for clockwise movement towards the horizontal bracket 15 of the frame, i.e., until projection 21 again contacts the bracket 15. It will be recognized that other suitable biasing means may be provided for effecting movement of the support member 14 towards the bracket, e.g., a spring; preferably, a counter-balance weight is employed since it requires less maintenance and provides greater reliability of operation.

The pivotal support member is held in the position shown in FIG. 2 by the counter weight 20 and projection 21. While the support member is in this thread-up position, the yarn break-detector element is in position to receive yarn from the yarn processing apparatus.

In this stage of thread-up, the yarn 5 is looped over the detector element 22 and is then returned to the pirn building means of the draw-twister device. With this arrangement, the loop of yarn applies a force to the break-detector element 22 and to the pivotal support member 14 so that these parts are moved downwardly, i.e., rotated clockwise, to place the stop-motion device in its operating position. The downward movement of the pivotal support member is limited by contact of projection 21 with the end portion of bracket 15. The operating or running position of the stop-motion device is illustrated in FIGS. 4 and 5.

Figure 4:
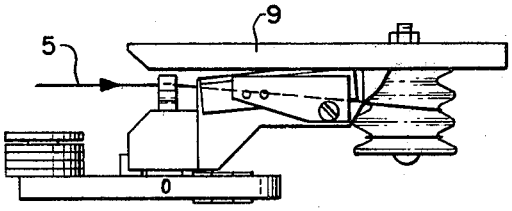
FIG. 4 is a top view of the stop-motion device in its operative position, i.e., during normal operation for detecting a break in the yarn passing through the associated yarn-processing machine.
Figure 5:
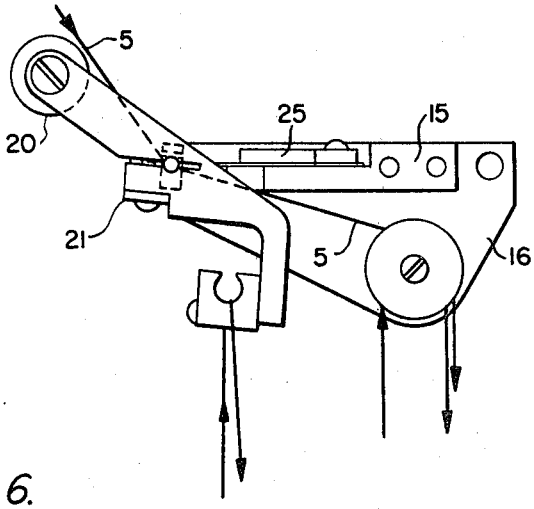
FIG. 5 is a front elevational view of the stop-motion device in the operative, running position shown in FIG. 4.

In the position shown in FIG. 4, the yarn 5 has been caused to advance from notch 6 over a sloping guide surface into notch 10. At the same time, the notch 10 is positioned to face downwardly so that the yarn 5 is guided along a linear path between the guide element 7 and the guide 8.

As shown in FIGS. 2, 3 and 4, a cutter blade 24 is clamped to the supported bracket 15 by a retaining plate 25 that is secured to the bracket by a screw or like fastener. The cutter blade 24 is arranged to form a V-shaped gap 26 with a vertical guide surface 28 provided by frame member 16. The vertical guide surface at the blade may be a resilient material, such as rubber, so that yarn is forced into a narrowing slot and subjected to the cutting action.

Figure 6:
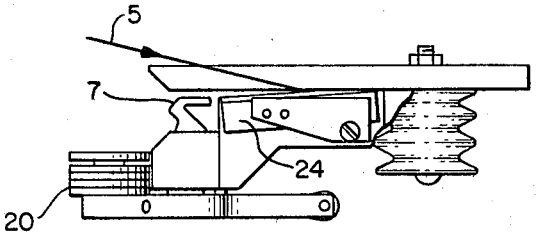
FIG. 6 is a top view of the stop-motion device in the cutdown position, i.e., after a yarn break has been detected and the yarn has been cut by the yarn cutting means.
Figure 7:
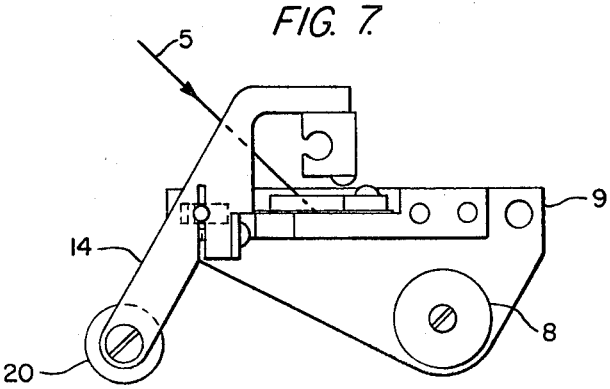
FIG. 7 is a front elevational view of the stop motion device in the cutdown position shown in FIG. 6.

When the yarn, during its travel in the yarn-processing apparatus, i.e., the draw-twisting apparatus, is broken, the yarn looped over element 22 is pulled away. When this occurs, the counter-weight 20 causes the pivotal support member 14 to rotate counter-clockwise so that yarn is released by guide element 7 into the gap of the yarn cutting means provided by cutter blade 24 and guide surface of frame member 16. The yarn 5 is then drawn across blade 24 and is cut. This final position of the device is shown in FIGS. 6 and 7.

In this manner, the stop-motion device of the present invention prevents a substantial amount of yarn from being drawn in by the feed roll and onto the draw-twister device after a breakage in the yarn has occurred, thereby preventing large wraps or snarls and tangles of yarn within the draw-twister device.

In order to again actuate the stop-motion device after the small amount of waste yarn has been removed from the draw-twister apparatus, the yarn is again threaded up as illustrated in FIGS. 2, 3, 4, and 5 so that the device is again in its operative or running position.

It will be understood that the number of wraps required for threading or stringing-up the draw-twister apparatus illustrated in FIG. 12 are merely illustrative of one specific string-up procedure and that other arrangements and other yarn-processing apparatus can be used in association with the yarn stop-motion device of the present invention. Also, it will be recognized that the number of loops of yarn which are placed over the second stationary yarn guide means is determined by the denier and other properties of the yarn being processed. In the arrangement shown in FIG. 1, the yarn from guide element 8 is initially looped around the presser roll and then over a second channel provided in element 8 before being passed between the presser roll and feed roll 3 and being introduced into the draw-twister device.

It will be understood that the stop-motion device as described herein is particularly suitable for use with yarn-processing apparatus wherein small to large denier yarns are employed, i.e., yarns for hosiery and the like, as well as for carpets.

What is claimed is:

1. A yarn stop-motion device for use with a yarn-processing apparatus, which comprises: yarn break-detector means for detecting a yarn break in the yarn processing apparatus; a cutting means for cutting the yarn being supplied to the yarn processing apparatus, and yarn guide means for guiding the yarn along a substantially linear path through said stop-motion device during normal operation of said yarn-processing apparatus, the yarn break-detector means, the cutting means and the yarn guide being positioned close to each other on one side of said yarn-processing apparatus and said yarn guide means releasing the yarn into said cutting means upon detection of a yarn break by said yarn break-detector means.

2. The device of claim 1, wherein the yarn break-detector means, the yarn cutting means and the yarn guide means are combined into a single unit.

3. A yarn stop-motion device operatively associated with and positioned on one side of a yarn-processing apparatus, said device comprising a supporting frame, a stationary yarn cutting means secured to said frame, yarn break-detector means for detecting a yarn break pivotally mounted on said frame, and yarn guide means for guiding the yarn along a substantially linear path spaced from said cutting means during thread-up and normal operation of said device and said yarn-processing apparatus and for releasing the yarn into said cutting means in the event of a detection of a yarn break by said yarn break-detector means.

4. The device of claim 3, wherein the means for cutting the yarn comprises a yarn guide surface on said supporting frame and a cutter blade adjacent said surface and secured to the frame.

5. The device of claim 4, wherein the blade is spaced from the guide surface to define a V-shaped gap.

6. The device of claim 4, wherein the guide means comprises a first movable guide element mounted on the frame and a second stationary guide element mounted on the frame and spaced from the first guide element.

7. A yarn stop-motion device operatively associated with a yarn-processing apparatus, said device comprising a supporting frame, a stationary yarn cutting means secured to said frame, yarn break-detector means for detecting a yarn break pivotally mounted on said frame, and yarn guide means for guiding the yarn along a path spaced from said cutting means during thread-up and normal operation of said device and yarn-processing apparatus and for releasing the yarn into said cutting means in the event of a detection of a yarn break by said yarn-break detector means; said cutting means comprising a yarn guide surface on said supporting frame and a cutter blade adjacent said surface and secured to the frame, said guide means comprising a first movable guide element mounted on the frame and a second stationary guide element mounted on the frame and spaced from the first guide element and said first guide element being a rotatable element provided with two notches for guiding the yarn, one notch guiding the yarn during string-up and the other notch guiding the yarn during normal operation.

8. The device of claim 3 or 7, wherein said yarn break-detector means comprises a pivotal support member which carries two arms and said first guide element is mounted on one of said arms, while the other arm carries a counter-weight for effecting movement of the pivotal support member in event of yarn breakage.

9. The device of claim 7, wherein said first yarn guide element is a shaped element that extends in a given plane during string-up, said element having a sloped yarn guiding surface that extends from an inner surface of one notch to the end surface of the guide element overlying the other notch, whereby rotation of the guide element from the given plane to a second plane which causes the yarn to advance from the one notch to the other notch.

10. The device of claim 9, wherein said yarn break-detector means comprises a pivotal support member and a yarn break-detector element mounted on said support member, said first guide element being mounted to rotate with said pivotal support member and said break-detector element guiding and retaining a portion of the yarn that has been processed by said yarn-processing apparatus.

11. A yarn stop-motion device operatively associated with a yarn-processing apparatus, said device comprising a supporting frame, a stationary yarn cutting means secured to said frame, yarn-break detector means pivotally mounted on said frame for detecting a yarn break, and yarn guide means for guiding the yarn along a path space from said cutting means during thread-up and normal operation of said device and said yarn processing apparatus and for releasing the yarn into said cutting means in the event of a detection of a yarn break by said yarn-break detector means; said guide means comprising a rotatable guide element provided with two guide member for guiding the yarn, one guide member guiding the yarn during string-up and the other guide member guiding the yarn during normal operation.

12. The device of claim 11, wherein said rotatable guide element is operatively associated with said pivotally mounted yarn-break detector means whereby said rotatable guide element is caused to rotate and to release the yarn upon pivotal movement of said yarn break-detection means in the event of the detection of a yarn break.

* * * * *